US012239207B2

(12) United States Patent
Van Der Blom et al.

(10) Patent No.: US 12,239,207 B2
(45) Date of Patent: Mar. 4, 2025

(54) PACKAGED DEODORANT STICK PRODUCT

(71) Applicant: Conopco, Inc., Englewood Cliffs, NJ (US)

(72) Inventors: Frank Van Der Blom, Eindhoven (NL); Benjamin George Oglesby, Leeds (GB); Cornelius Sebastianus Maria Verhoeve, Veghel (NL)

(73) Assignee: CONOPCO, INC., Englewood Cliffs, NJ (US)

( * ) Notice: Subject to any disclaimer, the term of this patent is extended or adjusted under 35 U.S.C. 154(b) by 178 days.

(21) Appl. No.: 17/771,331

(22) PCT Filed: Oct. 20, 2020

(86) PCT No.: PCT/EP2020/079453

§ 371 (c)(1),
(2) Date: Apr. 22, 2022

(87) PCT Pub. No.: WO2021/078715

PCT Pub. Date: Apr. 29, 2021

(65) Prior Publication Data

US 2022/0378175 A1 Dec. 1, 2022

(30) Foreign Application Priority Data

Oct. 24, 2019 (EP) ..... 19204993

(51) Int. Cl.
*A45D 40/12* (2006.01)
*A45D 40/00* (2006.01)

(52) U.S. Cl.
CPC ..... *A45D 40/12* (2013.01); *A45D 2040/0043* (2013.01); *A45D 2040/0062* (2013.01)

(58) Field of Classification Search
CPC ..... A45D 40/12; A45D 2040/0043; A45D 2040/0062; A45D 40/00; A45D 2040/0025; A45D 2040/0031; A45D 2040/005
(Continued)

(56) References Cited

U.S. PATENT DOCUMENTS 2,913,103 A 11/1959 Isele
3,656,628 A 4/1972 Dulberg
(Continued)

FOREIGN PATENT DOCUMENTS

CN 1306403 8/2001
CN 201731234 2/2011
(Continued)

OTHER PUBLICATIONS

Refills; MyMyro.com; 2023; 13 pages, retrieved 2023 from https://www.mymyro.com/collections/all#refills.
(Continued)

*Primary Examiner* — David J Walczak
(74) *Attorney, Agent, or Firm* — Stephanie Huang

(57) ABSTRACT

A packaged deodorant stick product comprising a deodorant stick composition, a retaining member and a holder, the deodorant stick composition being mounted on the retaining member and the retaining member comprises one of a bayonet element and a socket and the holder comprises the other of the bayonet element and the socket, wherein the bayonet element is lockably receivable within the socket such that the retaining member is removably connectable to the holder.

20 Claims, 6 Drawing Sheets

(58) Field of Classification Search
USPC ..... 401/88–90
See application file for complete search history.

(56) References Cited

U.S. PATENT DOCUMENTS

| | | | | |
|---|---|---|---|---|
| 4,235,557 | A | 11/1980 | Hayes | |
| 4,915,234 | A | 4/1990 | Boeller | |
| 5,092,700 | A | 3/1992 | Susini et al. | |
| 5,240,337 | A * | 8/1993 | Gruner | A45D 40/06 401/86 |
| 5,468,084 | A | 11/1995 | Boninsegni et al. | |
| 5,496,122 | A | 5/1996 | Fattori | |
| 5,738,123 | A * | 4/1998 | Szekely | A45D 40/16 401/98 |
| 5,799,667 | A | 9/1998 | Szekely | |
| 5,813,784 | A | 9/1998 | Durliat | |
| 6,293,719 | B1 | 9/2001 | Ohba | |
| 6,688,795 | B1 * | 2/2004 | Jacob | B43M 11/06 401/262 |
| 8,651,308 | B1 | 2/2014 | Sung | |
| 8,961,048 | B2 | 2/2015 | Baines et al. | |
| 10,039,366 | B1 | 8/2018 | Facer et al. | |
| 10,492,586 | B2 | 12/2019 | Paquet | |
| 10,542,814 | B2 | 1/2020 | Kelders | |
| 10,799,007 | B2 | 10/2020 | Schlatter | |
| 11,406,168 | B2 | 8/2022 | Briana | |
| 11,712,100 | B2 | 8/2023 | Arora et al. | |
| 11,839,287 | B2 * | 12/2023 | Arora | A45D 40/00 |
| 2005/0178785 | A1 | 8/2005 | Erickson | |
| 2006/0233589 | A1 | 10/2006 | Heukamp | |
| 2008/0145133 | A1 | 6/2008 | Facer | |
| 2010/0129135 | A1 | 5/2010 | Strange et al. | |
| 2015/0344288 | A1 | 12/2015 | Ortega Collado | |
| 2017/0007003 | A1 | 1/2017 | Paguet | |
| 2017/0164716 | A1 | 6/2017 | Lee | |
| 2017/0215552 | A1 | 8/2017 | Keller et al. | |
| 2018/0027947 | A1 | 2/2018 | Quennessen et al. | |
| 2018/0072483 | A1 | 3/2018 | Meranus | |
| 2018/0344011 | A1 * | 12/2018 | Paquet | A45D 40/22 |
| 2022/0087397 | A1 | 3/2022 | Arora et al. | |
| 2022/0160101 | A1 | 5/2022 | Zhou | |
| 2022/0378175 | A1 | 12/2022 | Van Der Blom | |
| 2023/0320475 | A1 | 10/2023 | Gray et al. | |

FOREIGN PATENT DOCUMENTS

| | | |
|---|---|---|
| CN | 104687718 | 6/2015 |
| CN | 105050911 | 11/2015 |
| CN | 106572946 | 4/2017 |
| DE | 9318425 | 5/1994 |
| FR | 2726442 | 5/1996 |
| FR | 2729279 | 7/1996 |
| FR | 2882235 | 8/2006 |
| GB | 598838 | 2/1948 |
| JP | 9252837 | 9/1997 |
| JP | 10179250 | 7/1998 |
| JP | 2002291527 | 10/2002 |
| JP | 2010178828 | 8/2010 |
| JP | 2014161637 | 9/2014 |
| JP | 2015009961 | 1/2015 |
| JP | 2018153233 | 10/2018 |
| KR | 101837581 | 3/2018 |
| RU | 2199256 | 2/2003 |
| RU | 2299663 | 5/2007 |
| RU | 2438545 | 1/2012 |
| WO | WO9405180 | 3/1994 |
| WO | WO0008970 | 2/2000 |
| WO | WO2005068308 | 7/2005 |
| WO | WO2007093286 | 8/2007 |
| WO | WO2011071792 | 6/2011 |
| WO | WO2012141522 | 10/2012 |
| WO | WO2013118969 | 8/2013 |
| WO | WO2017078745 | 5/2017 |
| WO | WO2018202385 | 11/2018 |
| WO | WO2020152223 | 7/2022 |

OTHER PUBLICATIONS

Search Report and Written Opinion in PCTEP2021073370; Nov. 24, 2021; World Intellectual Property Org. (WIPO).
IPRP1 in PCTEP2021073370; Mar. 9, 2023; World Intellectual Property Org. (WIPO).
IPRP1 in PCTEP2020051524; Aug. 5, 2021; World Intellectual Property Org. (WIPO).
Written Opinion of the IPEA in PCTEP2020051523; Dec. 17, 2020; World Intellectual Property Org. (WIPO).
Search Report and Written Opinion in EP23170506; Jul. 11, 2023; European Patent Office (EPO).
IPRP1 in PCTEP2020079453; May 5, 2022; World Intellectual Property Org. (WIPO).
Search Report and Written Opinion in PCTEP2022081277; Jan. 27, 2023; World Intellectual Property Org. (WIPO).
Search Report and Written Opinion in EP21210994; 20-May 2022; European Patent Office (EPO).

* cited by examiner

PACKAGED DEODORANT STICK PRODUCT

RELATED APPLICATIONS

The present application is a national phase filing under 35 USC 371 of International Application No. PCT/EP2020/079453, filed on Oct. 20, 2020, which claims priority from European Patent Application No. 19204993.0, filed on Oct. 24, 2019, the contents of which are incorporated herein in their entirety for all purposes.

FIELD OF INVENTION

The field of the invention is packaged deodorant stick products, in particular packaging/dispensers therefor.

Deodorant stick products are capable of reducing body malodour following topical application. Topical application is typically achieved by drawing the top of a deodorant stick composition across the skin of the human body, particularly in the underarm regions.

The action of drawing the deodorant stick composition across the underarm regions places strong lateral forces on the deodorant stick composition, requiring it to have good physical strength and resistance to shear forces of this sort. The deodorant stick products of the present invention are especially designed to resist these forces.

Herein, the term "deodorant stick composition" may be abbreviated to "composition".

Herein, preferred features of the invention are particularly preferred when used in combination with other preferred features.

Herein, "ambient conditions" refers to about 20° C. and 1 atmosphere pressure, unless otherwise indicated.

Herein, all numbers, amounts and ratios may optionally be understood to be modified by the word "about", unless otherwise indicated.

Herein, the word "comprising" is intended to mean "including" but not necessarily "consisting of", i.e., it is non-exhaustive.

Herein, "cosmetic" methods and compositions should be understood to mean non-therapeutic methods and compositions, respectively.

Herein, locational terms, such as terms denoting relative positioning, such as "upper", lower", "top", "bottom", refer to the stick product orientated such the deodorant stick composition is immediately above its retaining member which is above the associated holder.

Herein, "packaging elements" is intended as a collective term for some or all of: a retaining member, a holder and a cap.

Herein, deodorant sticks are typically antiperspirant stick compositions, i.e. antiperspirant sticks. Such sticks are capable of reducing perspiration, following topical application, as well as reducing body malodour. Herein, references to deodorant sticks should be understood to apply equally to antiperspirant sticks.

BACKGROUND

The invention relates to a deodorant stick product (for example, a deodorant and/or antiperspirant product for application to human axillary regions) and associated packaging/dispenser. More specifically, the invention relates to a package/dispenser for deodorant stick products wherein the product is fully exposed for use on a support, which package does not require a structure for elevating the product out of the package for use.

Current deodorant stick products generally comprise a deodorant stick composition surrounded on all sides by a plastic container and having some means, typically a platform and an associated spindle, designed to elevate the deodorant stick composition out of the top of the plastic container. The container may be used until the composition is exhausted and then disposed of in its entirety.

It has been desired to provide improved packages for deodorant stick products, wherein the package is simple—that is, does not require a mechanism for elevating the product out of a housing, which mechanism increases the cost of the package and makes the package more complex.

U.S. Pat. No. 5,496,122 (Mennen, 1996) discloses a replaceable stick deodorant package wherein the product is completely exposed on a retaining member and the process by which such products may be manufactured. The composition is held on a retaining member which is snap-fit assembled into a handle.

U.S. Pat. No. 4,235,557 (Ethyl Corp., 1980) discloses a dispensing device for a hot-filled solid product, such as an antiperspirant stick composition, the composition being held on a product holding structure which is screw-fitted into a handle.

SUMMARY OF INVENTION

In a first aspect of the invention, there is provided a packaged deodorant stick product comprising a deodorant stick composition, a retaining member and a holder, wherein the deodorant stick composition is mounted on the retaining member, the retaining member comprises one of a bayonet element and a socket and the holder comprises the other of the bayonet element and the socket, and wherein the bayonet element is lockably receivable within the socket such that the retaining member is removably connectable to the holder.

In such embodiments of the invention the retaining member and associated deodorant stick composition may be connected to the holder by a user of the product. The deodorant stick composition may then be consumed by use until it requires replacement.

The user may then disconnect the retaining member from the holder, discard it and the associated exhausted composition and replace it with a new retaining member and associated fresh composition.

In some embodiments of the invention the retaining member, and the deodorant stick composition mounted thereon, may be removably connectable to the holder. Therefore the holder may be reused multiple times by simply removing an old retaining member with an exhausted deodorant stick composition and connecting a new retaining member with a fresh composition mounted on it.

In such embodiments, the holder may form the majority of the dispensing packaging, hence the majority of packaging material comprised in the deodorant stick product is reusable. Only the relatively minor element of the dispensing packaging, the retaining member, need be discarded and replaced. This greatly reduces the quantity of packaging material that is consumed when using the invention.

In such embodiments the packaging material may be a plastic.

In some embodiments of the invention, the deodorant stick composition may be rigidly mounted to the retaining member with the majority of the composition exposed so that there is no need to elevate or dispense it from the packaging.

In such embodiments, the use of any platform or spindle, such as those used in known deodorant stick products, is not required. Hence the need for dispensing materials is greatly reduced, if not eliminated, from the product.

The holder enables the deodorant stick product to be easily held in one hand and for the composition to be applied to the desired surface.

A further benefit of the invention is that the deodorant stick composition can be placed or replaced in its holder without need for hand contact with the deodorant stick composition.

In embodiments of the invention, the retaining member comprises a first connection surface from which the bayonet element extends, and wherein the holder comprises a second connection surface on which the socket is positioned.

In such embodiments of the invention, a user of the deodorant stick product may connect the retaining member, and the deodorant stick composition mounted thereon, to the holder by inserting the bayonet element into the socket.

The deodorant stick product may have an oval cross-section when viewed from above. In other embodiments of the invention, the deodorant stick product may have an obround cross-section when viewed from above. In further embodiments of the invention the deodorant stick product may have any suitably shaped cross-section.

Herein, "major axis" refers to an axis extending along the longest diameter of the oval/obround cross-section and "minor axis" refers to an axis extending along the shortest diameter of the oval/obround cross-section.

Also herein, "central axis" refers to an axis that is normal to the cross-section and extends through its centre. Central axes may be defined through both the retaining member and the holder such that, when the retaining member is connected to the holder, the retaining member and holder are coaxial along their central axes.

Further, central axes may be defined through both the bayonet element and the socket. The central axis of the bayonet element and the central axis of the socket may each extend coaxially along the central axis of the oval cross-section of the product. This makes insertion of the bayonet element into the socket an intuitive action that can be performed without a direct line of sight of the bayonet element and socket.

When the retaining member is connected to the holder via the bayonet element and socket, the retaining member is immobile along its central axis relative to the holder. The axial immobility of the retaining member differentiates it from the majority of 'platforms' used in conventional deodorant sticks. A deodorant stick product according to such embodiments of the invention may facilitate swifter and more convenient use of the product as a user is able to apply the deodorant stick composition immediately without needing to spend time raising a platform holding the deodorant stick composition (typically by rotation) before each use.

In embodiments of the invention, the socket comprises a retention shelf, and the bayonet element comprises a protrusion engageable with the retention shelf, whereby when the protrusion is engaged with the retention shelf the bayonet element is locked within the socket.

In such embodiments, the retaining member may be securely locked to the holder so that the two components are unlikely to separate unintentionally while the product is being used. There may be more than one retention shelf and a corresponding number of radial protrusions.

In such embodiments of the invention, the protrusion may extend outwardly from the bayonet element and further the protrusion may extend radially outwardly from the bayonet element. Also, the retention shelf may extend inwardly from the socket and further the retention shelf may extend radially inwardly into an opening of the socket through which the bayonet element is receivable.

It is to be understood that in some embodiments there may be a single protrusion and a single retention shelf whereas in other embodiments there may be more than one protrusion and there may be more than one retention shelf. Further, there may be more or fewer protrusions than there are retention shelves.

In embodiments of the invention, the bayonet element comprises a pair of flanges and each flange comprises a protrusion.

In such embodiments the bayonet element may be formed of the pair of flanges which extend parallel to one another from the first connection surface of the retaining member. Each flange may comprise a protrusion that extends outwardly from the bayonet element.

In embodiments of the invention, the retaining member comprises one of a detent and an indent, and the holder comprises the other of the detent and the indent, wherein the indent is adapted to receive the detent.

In such embodiments the retaining member may be connected to the holder by inserting the bayonet element into the socket and rotating the bayonet element relative to the socket to engage the protrusion with the retention shelf. When the protrusion is engaged with the retention shelf, the detent may be received by the indent. This may provide resistance to further rotation of the bayonet element relative to the holder and thereby maintain engagement of the protrusion with the retention shelf when the deodorant stick product is in use.

In embodiments of the invention, the bayonet element is rotatable relative to the socket between a first position and a second position such that in the first position the radial protrusion is not engaged with the retention shelf, and the detent is not received by the indent, and in a second position the radial protrusion is engaged with the retention shelf and the detent is received by the indent.

In such embodiments the socket may comprise an opening and the retention shelf may extend inwardly from the opening. This results in the dimensions of the opening being reduced where the retention shelf extends into the opening. The dimensions of the opening of the socket may thus be adapted to allow the bayonet element to be inserted into the socket only when the protrusion is in a particular orientation. This will occur when the bayonet element is in the first position.

The dimensions of the socket may be adapted to accommodate the bayonet element with the protrusion in any orientation. This means that the bayonet element may be rotated relative to the socket once the bayonet element has been inserted into the socket.

The protrusion and the retention shelf may be configured so that rotation of the bayonet element, relative to the socket, to a second position when the bayonet element is positioned within the socket causes the protrusion to slide under the retention shelf. The protrusion is thereby engaged with the retention shelf when the bayonet element is in the second position.

In the second position the protrusion is in an orientation where the opening of the socket cannot accommodate the dimensions of the bayonet element due to the presence of the retention shelf. This means that it is not possible to withdraw the bayonet element directly out of the socket when the bayonet element is in the second position. In other words, the bayonet element is locked within the socket and the retaining member is thereby connected to the holder.

Further, in the second position, the detent is received by the indent. This provides a resistance to further rotation of the bayonet element relative to the holder and thereby maintains the orientation of the protrusion in engagement with the retention shelf when the deodorant stick product is in use. Therefore the bayonet element remains locked within the socket and the retaining member (and associated deodorant stick composition) remains connected to the holder.

In some embodiments of the invention the detent is resiliently deformable. In such embodiments, the retaining member may be disconnected from the holder by the application of a rotational force to the retaining member relative to the holder that is sufficient to deform the detent such that it withdraws from the indent.

In other words, although it is unlikely, if not impossible, that a retaining member will accidentally disconnect from a holder when a deodorant stick product is in use, it is possible for a user to purposefully disconnect the retaining member from the holder and replace it with a new one if they choose.

The holder is designed to removably connect with the retaining member by the means described above. It is also designed to allow the product to be held in the human hand. The holder enables easy application of the deodorant stick composition to the skin of the human body.

In embodiments of the invention the retaining member comprises a retaining structure which projects from a retaining surface of the retaining member.

In such embodiments the retaining surface may be spaced apart from the first connection surface. The deodorant stick composition is mounted on the retaining surface of the retaining member. Retention of the deodorant stick composition is enhanced by the retaining structure which projects from the retaining surface, away from the first connection surface and into the composition.

Therefore, in embodiments of the invention, the retaining structure is embedded in the deodorant stick composition.

The deodorant stick compositions used in the invention are solid in nature, typically having a melting point of greater than 40° C. at 1 atmosphere pressure. The deodorant stick composition may have a melting point at 1 atmosphere pressure of greater than 50° C. or greater than 60° C. Whether the melting point at 1 atmosphere pressure is greater than 40° C., 50° C. or 60° C., the melting point may be less than 90° C.

Herein, a deodorant stick composition is considered to have become molten when it is capable of flow solely under the influence of gravity and the melting point is defined as the temperature at which it becomes molten.

The deodorant stick composition is generally formed and attached to the retaining member by a hot-fill process whereby molten deodorant stick composition is typically poured into a mould, placed in contact with the retaining member whilst still molten and then allowed to cool to form a solidified composition attached to the retaining member. Further, the retaining structure may be submerged into the molten stick composition so that, when the composition is allowed to cool, it solidifies around the retaining structure.

In such embodiments single-use packaging material is not required around external walls of the deodorant stick composition in order to retain the composition within the deodorant stick product, as is typically required in known deodorant stick products. Therefore, the amount of single-use packaging material required to produce a deodorant stick product according to such embodiments of the invention is reduced in comparison to known deodorant stick products.

In embodiments of the invention the retaining structure comprises a plurality of bridge structures. Further, in embodiments of the invention, the bridge structures are curved bridge structures.

In such embodiments the bridge structures may be separated by apertures that extend through the retaining member from the retaining surface to the first connection surface. The bridge structures project upwardly from the retaining member and away from the first connection surface. Further, the bridge structures project into the deodorant stick composition and are embedded therein.

During manufacture, molten composition passes through the apertures and surrounds the bridge structures. When the composition is solidified, the bridge structures are embedded therein. This greatly strengthens the retention of the deodorant stick composition by the retaining structure, reducing the likelihood that the composition becomes fractured or shears off during use.

In embodiments of the invention, the product has an oval cross-section. In such embodiments the retaining structure has an oval cross-section also. The bridge structures, and apertures therebetween, pass across the breadth of the retaining member in a direction parallel to the minor axis of the oval-cross-section of the product.

In embodiments of the invention, the deodorant stick product comprises a cap, wherein the deodorant stick composition is receivable within the cap and the cap is attachable to the holder.

In such embodiments of the invention, the cap may be attached to the holder such that it covers the deodorant stick composition. The cap therefore protects the stick composition from damage and from drying out over time.

Herein, the term "hardness" relates to how much force is required to move a penetration cone a specified distance and at a controlled rate into a deodorant stick composition under the following test conditions. Values are measured at 27° C., 15% relative humidity, using a TA-XT2 Texture Analyzer, available from Texture Technology Corp., Scarsdale, NY., USA. The product hardness value represents the peak force required to move a standard 45° angle penetration cone through the composition for a distance of 10 mm at a rate of 2 mm/second. The standard cone is available from Texture Technology Corp., as part number TA-15, and has a total cone length of about 24.7 mm, angled cone length of about 18.3 mm, a maximum diameter of the angled surface of the cone of about 15.5 mm. The cone is a smooth, stainless steel construction and weighs 17. 8 grams.

In embodiments of the invention, the holder comprises an upper element and a lower element, which lower element is adapted to receive and hold the upper element.

In such embodiments the upper element comprises the second connection surface and the socket positioned on the second connection surface.

In some embodiments the upper element and the lower element may be separately formed. This allows the upper and lower elements to be formed of different materials that may provide different characteristics beneficial to each element. For example the upper element may be formed of a rigid material to provide secure attachment with the retaining member while the lower element may be formed of a resiliently deformable material that resistant to breaking if the deodorant stick product was dropped by a user. Further, the upper and lower elements may be adapted to provide empty space within the holder, thereby limiting the amount of packaging material required to produce the product. In other embodiments the upper and lower elements may be integrally formed.

In embodiments of invention, the deodorant stick has a hardness of at least 600-gram force.

In such embodiments the deodorant stick product may have a hardness from 600-gram force to 5000-gram force, from 750-gram force to 2000-gram force or from 800-gram force to 1400-gram force. This enables the stick to withstand the lateral forces encountered when it is topically applied. More particularly, it enables the stick to stay attached to its retaining member during such use.

Deodorant stick compositions of the invention do not require a plastic spindle running through them to aid in their elevation from their packaging. This is because the retaining structure of the retaining member is embedded in the deodorant stick composition and no further packaging is required to encase the perimeter of the composition in order to hold it to the packaging. The absence of a central spindle running through the deodorant stick composition is an advantage of the invention as it reduces the quantity of single-use packaging material required and the deodorant stick composition may be applied more quickly. However, the lack of a central spindle can have a detrimental effect of the structural strength of the stick and therefore relatively low ratios of deodorant stick composition height to other dimensions of the deodorant stick product may be beneficial (vide infra).

Herein, the height of a "holding material" is the combined height of the holder and the retaining member when they are connected. Also herein, an initial height of a deodorant stick composition is the height of the deodorant stick composition before it has been used.

In embodiments of the invention, the ratio of the initial height of deodorant stick composition to the height of the holding material is from 1:2 to 3:2.

Having the height of the deodorant stick relative to the height of the holding material within these ranges has been found to enhance the strength of the stick composition and to reduce its tendency to fracture or shear off.

In other embodiments the ratio is from 2:3 to 1:1.

Herein, a "breadth" of the deodorant stick product is the minimum cross-sectional diameter of the stick. For a stick deodorant stick product an oval cross-section, this equates to the minor axis of the oval.

In embodiments of the invention, the ratio of the initial height to the breadth of the deodorant stick composition is from 1:2 to 3:2.

Having the height of the deodorant stick relative to the breadth of the deodorant stick within these ranges has been found to enhance the strength of the stick composition and to reduce its tendency to fracture or shear off.

In other embodiments this ratio is from 2:3 to 4:3.

In embodiments of the invention the deodorant stick composition is an antiperspirant stick composition.

In such embodiments there is provided an antiperspirant stick product equivalent to the deodorant stick product according to the first aspect of the invention. The antiperspirant stick product may have the same, or similar, advantages over known antiperspirant stick products as the deodorant stick product according to the first aspect of the invention has over known deodorant stick products.

The packaging elements (e.g. cap, retaining member and holder) according to the present invention can be made of conventional materials for solid stick product packages (e. g. plastic materials). The packaging elements can be made by conventional injection moulding techniques, with the material of construction preferably being a thermoplastic material having suitable rigidity to withstand forces which the device will experience when the product is filled by a hot-fill technique into the package and when the consumer uses the product. The materials of construction must be able to withstand hot-fill temperatures without deformation, having a heat of deformation of greater than 50° C., preferably greater than 60° C., more preferably greater than 70° C. and most preferably greater than 80° C. Exemplary of materials that may be used are polyolefins, such as polypropylene or polyethylene, in particular high-density polyethylene.

In a second aspect of the invention, there is provided a method of applying a deodorant stick composition to the surface of the human body by use of a deodorant stick product according to the first aspect of the invention, particularly to deliver a deodorancy benefit or to reduce perspiration.

In a third aspect of the invention, there is provided a method of reducing perspiration comprising the use of a product according to the first aspect of the invention to topically apply a deodorant composition to the surface of the human body.

SPECIFIC EMBODIMENT

The invention will now be described by way of example only with reference to the accompanying drawings in which.

The Figures are not necessarily to the same scale.

Figure 1:
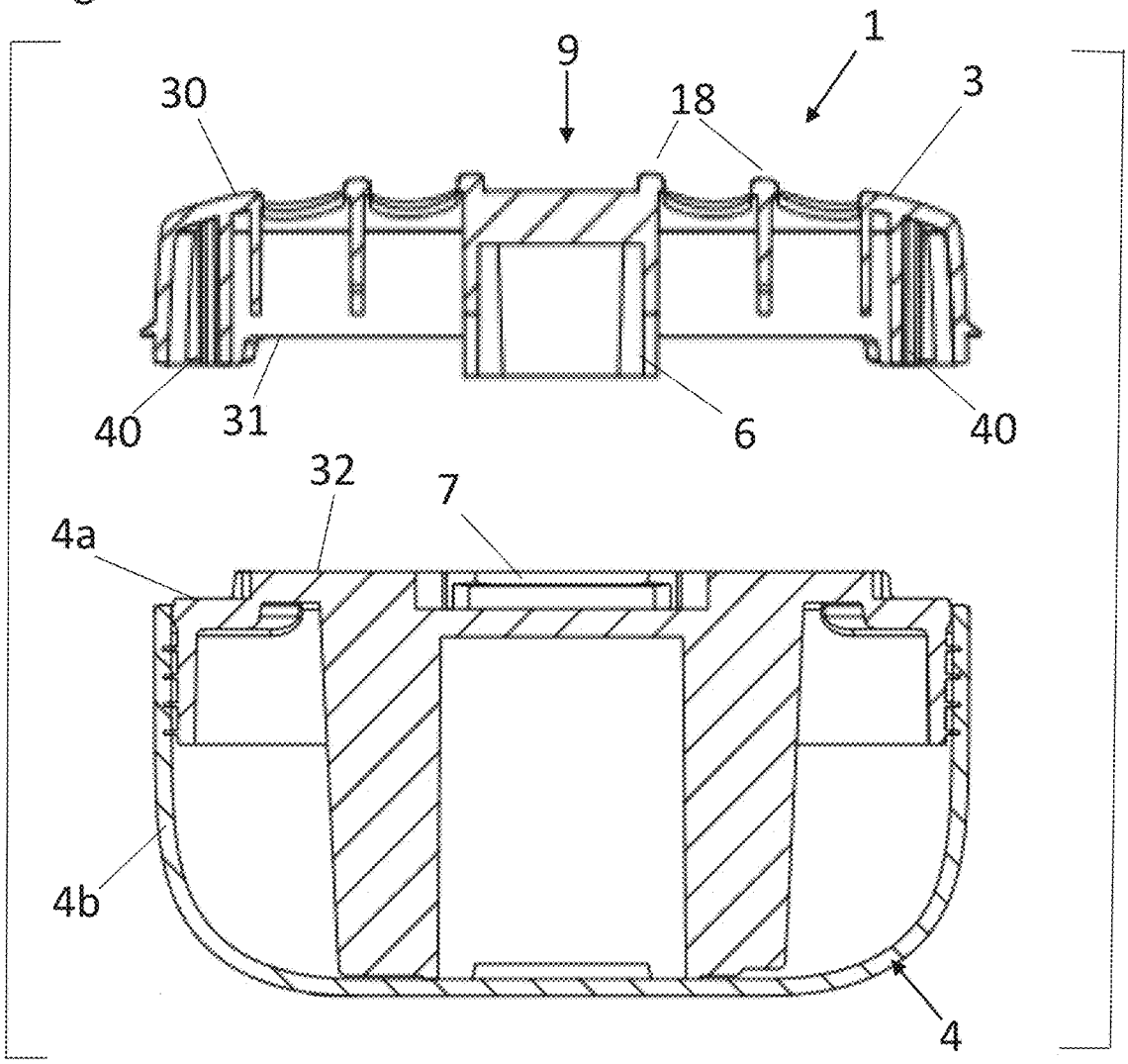
FIG. 1 is a schematic representation of a deodorant stick product according to the first aspect of the invention comprising a retaining member separated from a holder.

Referring initially to FIG. 1, a deodorant stick product according to an embodiment of the first aspect of the invention is designated generally by the reference numeral 1. The deodorant stick product (1) comprises a retaining member (3) and a holder (4) which are shown here separated from one another.

The retaining member (3) comprises a bayonet element (6), a retaining structure (9), a retaining surface (30), a first connection surface (31) and a pair of end portions 40. The bayonet element (6) extends from the first connection surface (31) which is spaced apart from the retaining surface (30). An end portion (40) extends parallel to the bayonet element (6) from each end of the retaining member (3).

A deodorant stick composition (not shown) may be mounted to the retaining member (3) wherein the retaining structure (9) is embedded within the deodorant stick composition and the deodorant stick composition extends from the retaining surface (30). The retaining structure (9) comprises a plurality of bridge structures (18) which projects away from the first connection surface 31. The plurality of bridge structures (18) are adapted to enhance the retention of the deodorant stick composition to the retaining member.

The holder (4) comprises an upper element (4A) and a lower element (4B). The upper element (4A) comprises a second connection surface (32) and a socket (7) positioned on the second connection surface (32). The lower element (4B) is adapted to receive and hold the upper element (4A). Typically, the upper element (4A) and the lower element (4B) are moulded independently and then fitted together.

Figure 2:
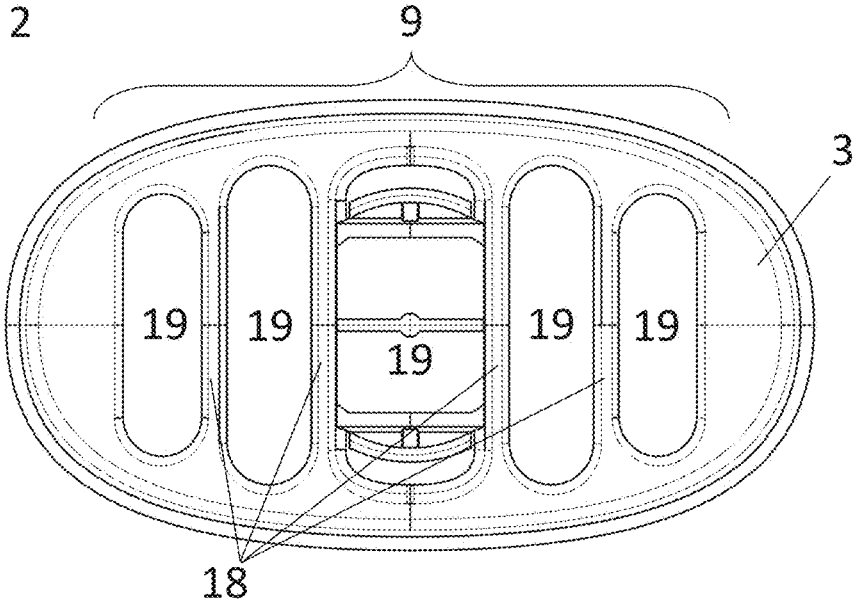
FIG. 2 is a top view of the retaining member shown in FIG. 1.

Referring now to FIG. 2, the retaining structure (9) of retaining member (3) is shown in more detail. In this embodiment of the invention the retaining structure (9) comprises four bridge structures (18). Each bridge structure (18) forms a bridge extending from one side of the retaining member (3) to the other substantially parallel to the minor axis of the retaining member (3). In other embodiments the plurality of bridge structures may be any suitable number of bridge structures.

The retaining structure (9) further comprises a plurality of apertures (19) that separate the bridge structures and that extend through the retaining member from the retaining surface (30) to the first connection surface (31).

During manufacture, molten deodorant stick composition passes through the apertures (19) and surrounds the bridge structures (18). When the molten composition is cooled and solidified, the bridge structures (18) are embedded therein. This greatly strengthens the retention of the deodorant stick composition by the retaining structure (9), reducing the likelihood that the composition becomes fractured or shears off during use.

Figure 3A:
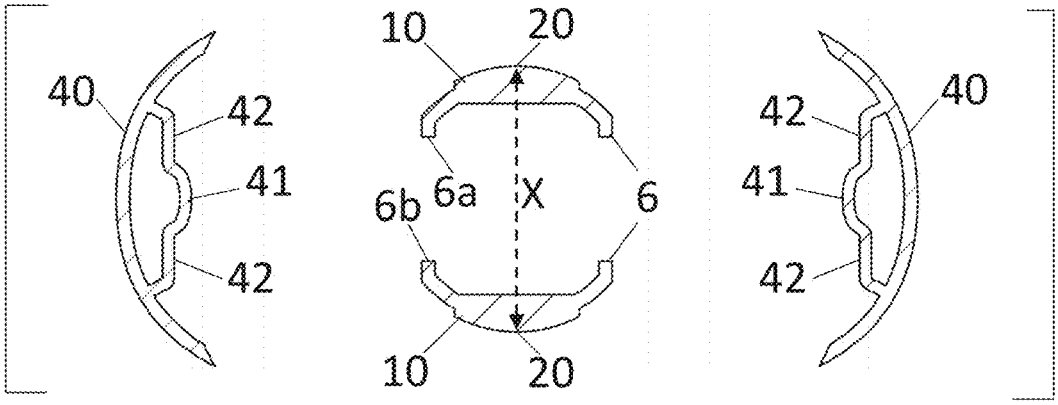
FIG. 3A is a cross-sectional representation of a bayonet element forming part of the retaining member of FIG. 1.
Figure 3B:
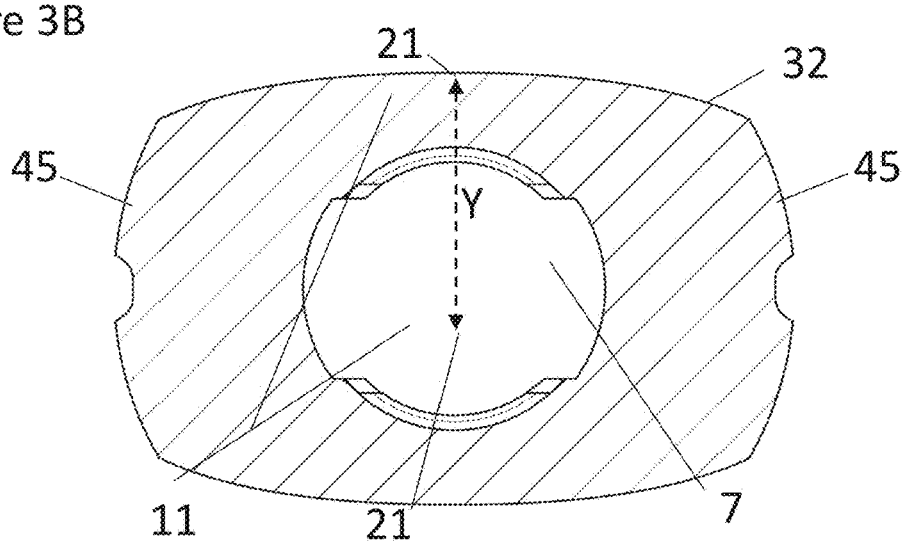
FIG. 3B is a cross-sectional representation of a socket forming part of the holder of FIG. 1.

Referring now to FIGS. 3A and 3B, the bayonet element (6), end portions (40) and socket (7) are shown in more detail. In FIG. 3A, a cross-section of the bayonet element (6) and the end portions (40) is provided. In this embodiment the bayonet element (6) comprises a pair of flanges (6*a*, 6*b*) wherein each flange extends parallel to one another from the first connection surface (31) of the retaining member (3).

Each flange (6*a*, 6*b*) comprises a protrusion (10) that extends outwards from the bayonet element (6). Each protrusion (10) comprises an outside edge (20) wherein the distance between the outside edge (20) of each protrusion (10) is shown as X.

Each end portion (40) comprises a detent support (42) and each detent support (42) comprises a detent (41).

In FIG. 3B, a cross-section of the second connection surface (32) is shown. The socket (7) comprises a pair of retention shelves (11) that extend inwardly from an opening of the socket (7). Each retention shelf (11) comprises an inner edge (21) wherein the distance between the inner edge (21) of each retention shelf (11) is shown as Y. The protrusions (10) and the retention shelves (11) are adapted such that distance X is greater than distance Y. (The distances X and Y are also shown in FIG. 4.)

The second connection surface (32) further comprises an indent (44) at each end thereof. Each indent (45) is adapted to receive a respective detent (41).

Figure 4:
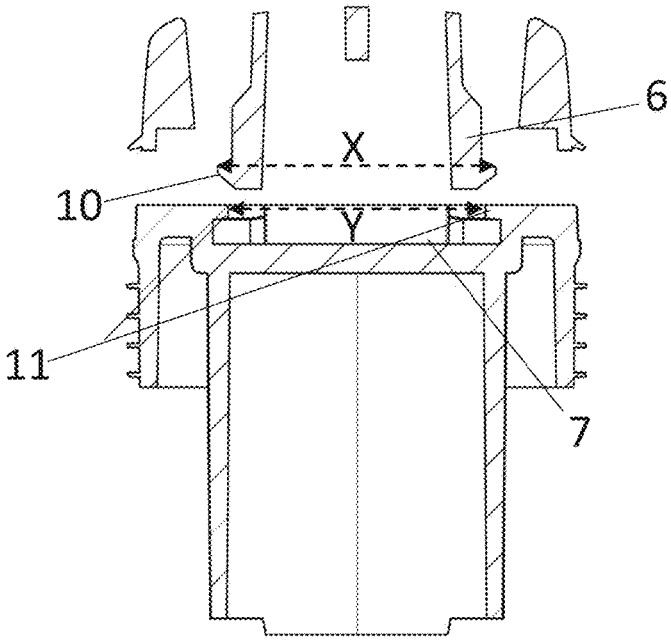
FIG. 4 is a cross-sectional view of the deodorant stick product of FIG. 1 showing the bayonet element and the socket.

Referring now to FIG. 4, a cross-sectional view of the retaining member (3) and the upper element of the holder (4A) is shown. Here the protrusions (10) are shown extending outwardly from the bayonet element (6) and the retention shelves (11) extend inwardly from the opening of the socket (7). It can be seen that, in this orientation, the bayonet element (6) cannot be fully inserted into the socket (7) because distance X is greater than distance Y. Or in other words, the retention shelves (11) prevent movement of the protrusions (10) into the socket (7).

Figure 5:
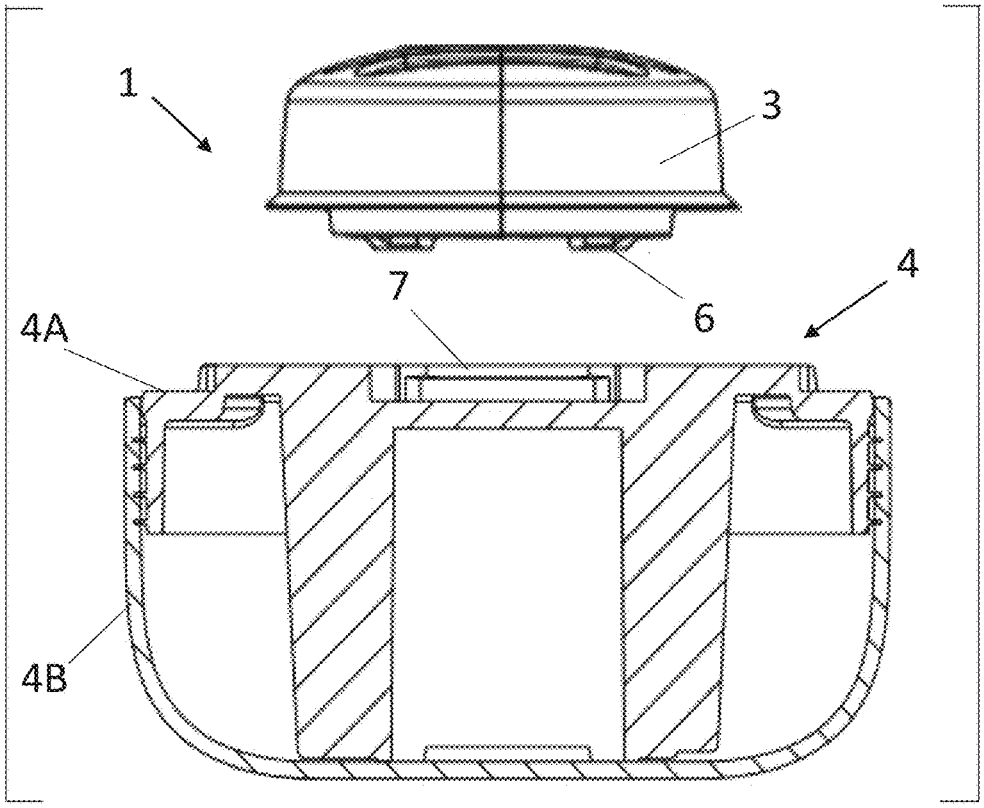
FIG. 5 is a view of the deodorant stick product shown in FIG. 1 showing the retaining member positioned ready to connect with the holder.

Referring now to FIG. 5, the deodorant stick product (1) is shown with the retaining member (3) positioned ready to be connected with the holder (4). The bayonet element (6) may be is inserted into the socket (7) by lowering the retaining member (3) into contact with the holder (4).

Figure 6:
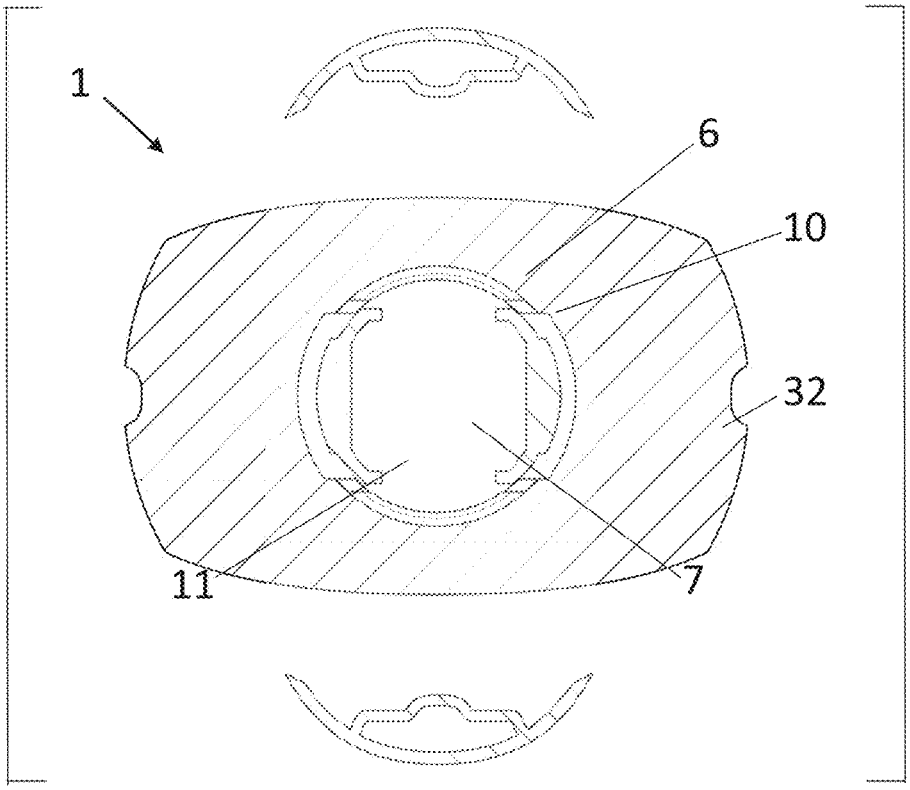
FIG. 6 is a cross-sectional view of the retaining member and the holder positioned as they are in FIG. 5.

In FIG. 6, a cross-sectional view is provided of the deodorant stick product (1) in the configuration shown in FIG. 5. It can be seen that, in this orientation, the relative positions of the socket (7) and the retention shelves (11) allow the bayonet element (6) to be fully inserted into the socket (7) when the bayonet element (6) is in a first position wherein the protrusions (10) are not engaged with the retention shelves (11).

Once the bayonet element (6) is inserted into the socket (7) in the orientation shown in FIG. 6, the protrusions (10) sit lower in the socket (7) than the retention shelves (11). This allows the bayonet element (6) to be rotated from the first position to a second position wherein the protrusions (10) slide under the retention shelves (11) such that the protrusions (10) are engaged with the retention shelves (11).

The rotation may be achieved by rotating the retaining member (3) relative to the holder (4) about its central axis by 90° (or vice versa).

Figure 7:
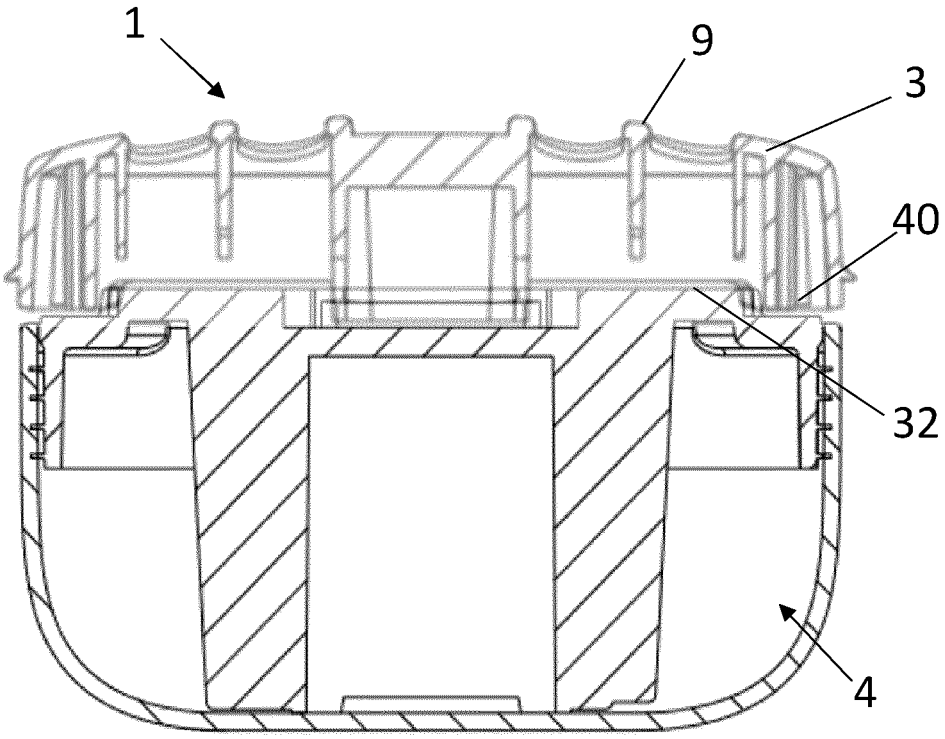
FIG. 7 is a view of the deodorant stick product (1) shown in FIG. 1, showing the retaining member connected to the holder.

Referring now to FIG. 7, the bayonet element (6) is in the second position and the retaining member (3) is thereby connected to the holder (4). In this orientation, the end portions (40) extend past the ends of the second connection surface (32). This allows the detents (41) to be received by the indents (45) (as is shown in FIG. 8).

Figure 8:
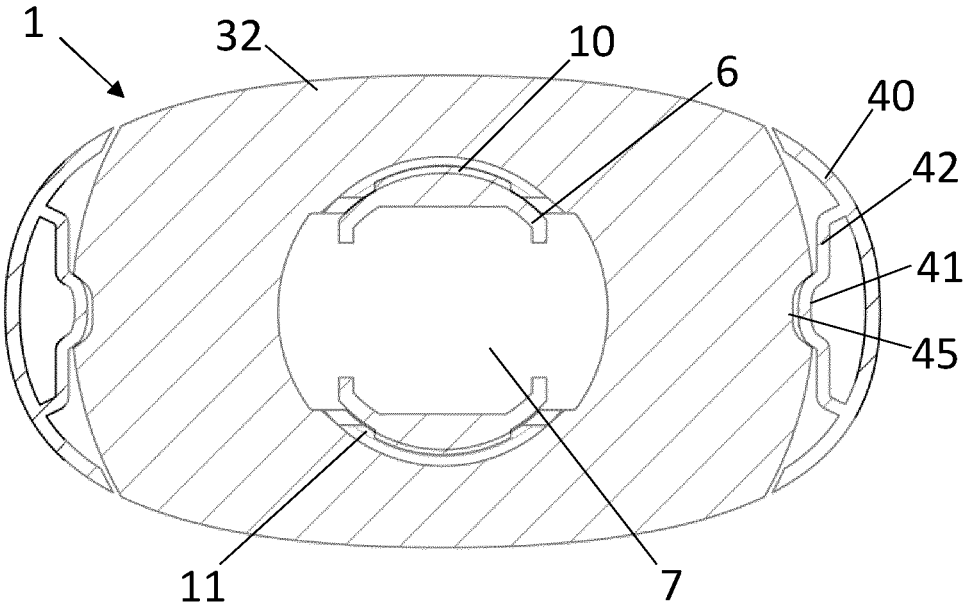
FIG. 8 is a cross-sectional view of the retaining member and the holder positioned as they are in FIG. 7.

Referring now to FIG. 8, a cross-sectional view of the deodorant stick product shown in FIG. 7 is provided. As shown, the retention shelves (11) overlap the protrusions (10), and therefore the protrusions (10) engage with the retention shelves (11). This means that the bayonet element (6) is locked within the socket (7) until the bayonet element (6) is rotated back to the first position.

In order to prevent the bayonet element (6) from rotating back to the first position accidentally, the indents (45) are adapted to receive the detents (41) when the bayonet element (6) is in the second position.

Herein, the maximum diameter of the second connection surface (32) is defined as the largest possible distance between any two points on the perimeter of the second connection surface (32). Also herein, the minimum distance between the pair of detents (41) is defined as the smallest possible distance between a point on one of the pair of detents and a point on the other of the pair of detents. The pair of detents are integrally formed as part of the retaining member, therefore the minimum distance between them is set by the size and shape of the retaining member.

Figure 9:
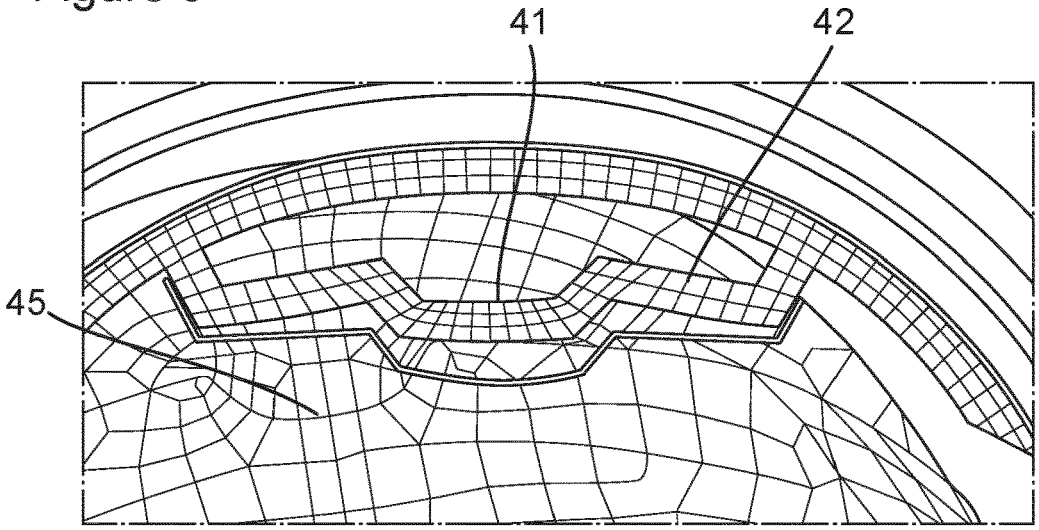
FIG. 9 is close-up view of the retaining member of FIG. 1, positioned in the process of attachment to the holder.

The maximum diameter of the second connection surface (32) is adapted to be greater than the minimum distance between the pair of detents (41). Therefore in order for the retaining member (3) to be rotated relative to the holder (4) so that the bayonet element (6) can rotate from the first position to the second position, each detent support (42) deforms as shown in FIG. 9 to allow each detent (41) to move outwards (away from the bayonet element (6)), thereby increasing the minimum distance between the pair of detents (41). The outward movement of the detents (41) allows the bayonet element (6) to be rotated fully towards the second position.

The shape of each end portion (40) is adapted such that a rotational force applied to the retaining member (3) causes the detents (41) to slidably abut against the second connection surface (32) and result in the necessary deformation of the detent supports (42) to move the detents (41) sufficiently outwards.

The detent supports (42) comprise a resiliently deformable material so that when each detent (41) aligns with its respective indent (45) the detent supports (42) return to their undeformed shape and each indent (45) receives a respective detent (41). Once the configuration shown in FIGS. 7 and 8 is reached, a further rotational force is required to cause deformation to the detent supports (42) again before the detents (41) can be moved outwards and the bayonet element (6) can be rotated away from the second position. The end portions (40) are adapted such that the rotational force required to cause deformation of the detent supports (42) is larger than would typically be applied during use of the deodorant stick product (1) but also easy for a user to apply intentionally in order to connect or disconnect a retaining member (3) from a holder (4). Hence it would be unlikely that the retaining member (3) would disconnect from the holder (4) accidentally during use of the deodorant stick product (1).

Further, the end portions (40) are adapted such that the detent supports (42) may resiliently deform to allow movement of the detents (41) while the overall retaining member (3) deforms very little. This is advantageous because if the retaining member (3), and particularly the retaining structure (9), were to deform significantly when the retaining member (3) is connected to the holder then the deodorant stick composition in which the retaining structure (9) is embedded may deform also. The deodorant stick composition is a wax-like structure and is not resiliently deformable, therefore deformation of the composition may cause it to become loose from the retaining structure (9). It is very undesirable for the composition to fall off the retaining member (3), hence it is beneficial to minimise deformation of the overall retaining member (3).

Figure 10:
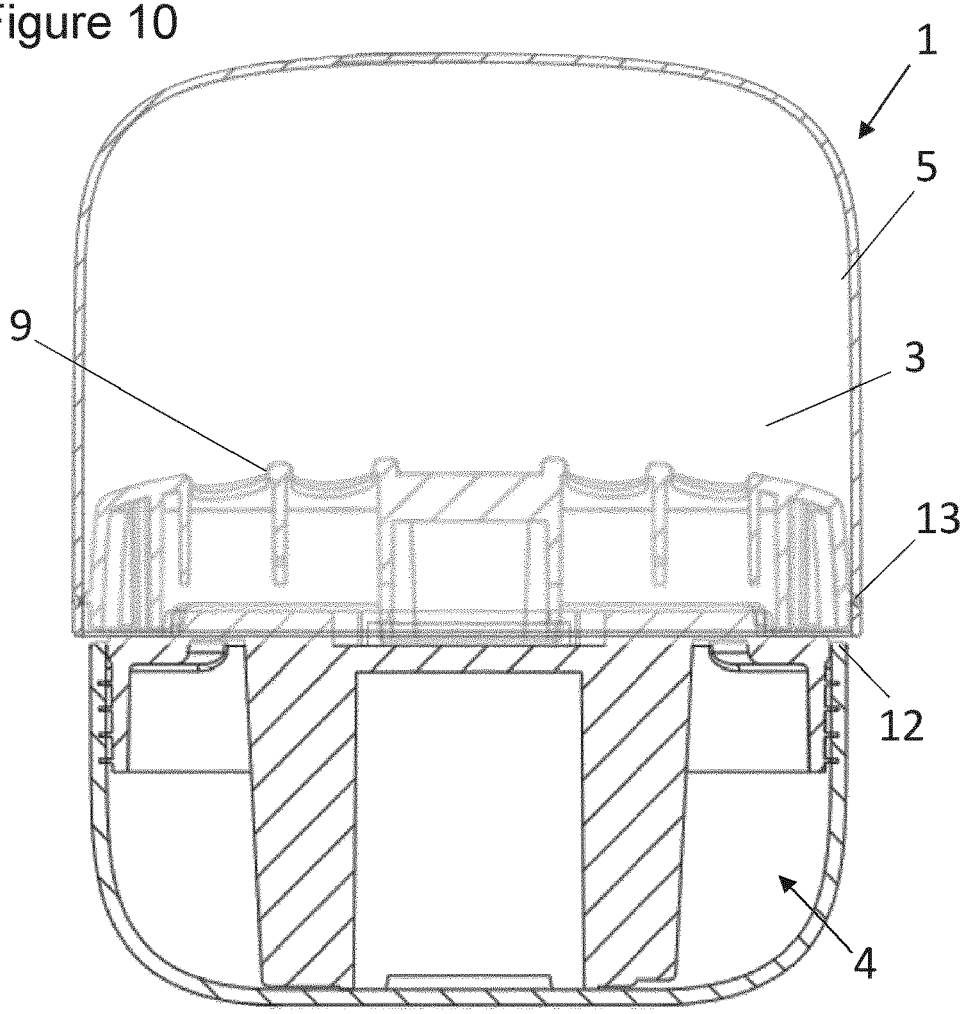
FIG. 10 is a schematic representation of the deodorant stick product of FIG. 1 with a cap attached to the holder.

Referring now to FIG. 10, the deodorant stick product (1) comprises a cap (5). The cap (5) is shown attached to the retaining member (3) and holder (4) which are connected together as they are in FIG. 7.

FIG. 10 provides a cross-section view of each of the cap (5), the retaining member (3) and the holder (4). The holder 4 comprises a ledge (12) that extends around the outer perimeter of the holder (4). The lower edge of the cap (5), sits on this ledge (12) when such a cap (5) is employed.

Figure 11:
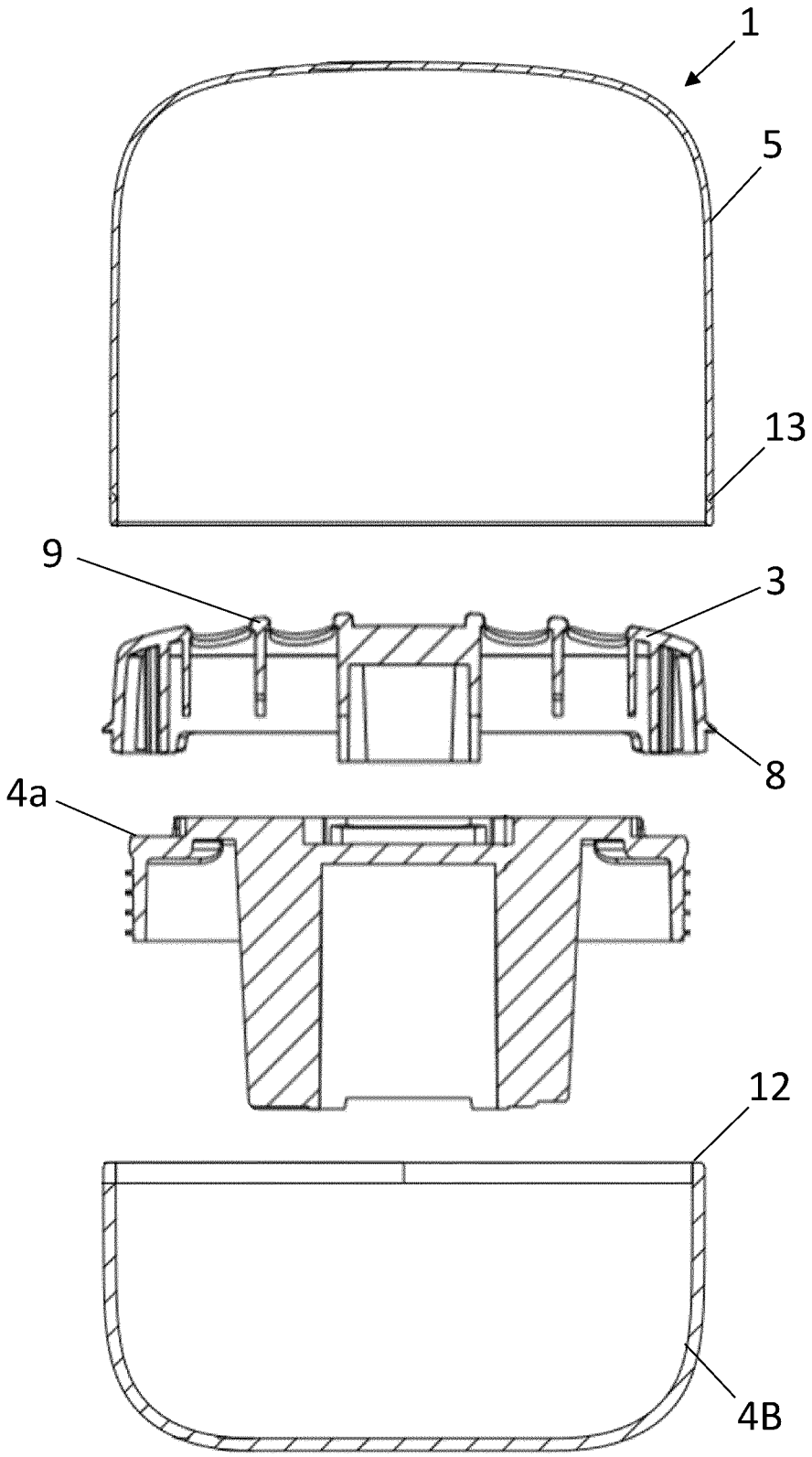
FIG. 11 is an exploded view of the deodorant stick product (1) shown in FIG. 10.

Referring now to FIG. 11, an exploded view of the deodorant stick product (1) shown in FIG. 10 is provided. In particular, the holder (4) is shown in more detail with the upper element (4A) separated from the lower element (4B).

The cap (5) comprises a retaining ring (13) that extends around its inner surface while the retaining member (3) comprises a small projection (8) that extends around the outer perimeter of the retaining member (3). The retaining ring (13) is adapted to accommodate the small projection (8) when the cap (5) is slid into place over the retaining member to sit on the ledge (12). The projection (8) and the retaining ring (13) form a reversible "click-lock" attachment of the cap (5) to the retaining member (4).

The invention claimed is:

1. A packaged deodorant stick product comprising a deodorant stick composition, a retaining member and a holder, wherein the deodorant stick composition is mounted on the retaining member, the retaining member comprises one of a bayonet element and a socket and the holder comprises the other of the bayonet element and the socket, wherein the bayonet element is lockably receivable within the socket such that the retaining member is removably connectable to the holder, and further wherein the retaining member comprises one of a detent and an indent and the holder comprises the other of the detent and the indent, where the indent is adapted to receive the detent.

2. The packaged deodorant stick product according to claim 1, wherein the retaining member comprises a first connection surface from which the bayonet element extends, and wherein the holder comprises a second connection surface on which the socket is positioned.

3. The deodorant stick product according to claim 1, wherein the socket comprises a retention shelf, and the bayonet element comprises a protrusion engageable with the retention shelf, whereby when the protrusion is engaged with the retention shelf the bayonet element is locked within the socket.

4. The deodorant stick product according to claim 3, wherein the bayonet element comprises a pair of flanges.

5. The deodorant stick product according to claim 1, wherein the holder forms a majority of the packaged deodorant stick product's dispensing packaging.

6. The deodorant stick product according to claim 1, wherein the bayonet element is rotatable relative to the socket between a first position and a second position such that in the first position a radial protrusion is not engaged with a retention shelf, and the detent is not received by the indent and in a second position the radial protrusion is engaged with the retention shelf and the detent is received by the indent.

7. The deodorant stick product according to claim 1, wherein the retaining member comprises a retaining structure which projects from a retaining surface of the retaining member.

8. The deodorant stick product according to claim 7, wherein the retaining structure is embedded in the deodorant stick composition.

9. The deodorant stick product according to claim 7, wherein the retaining structure comprises a plurality of bridge structures.

10. The deodorant stick product according to claim 1, having an oval cross section.

11. The deodorant stick product according to claim 1, comprising a cap, wherein the deodorant stick composition is receivable within the cap and the cap is attachable to the holder.

12. The deodorant stick product according to claim 1, wherein the holder comprises an upper element and a lower element, which lower element is adapted to receive and hold the upper element.

13. The deodorant stick product according to claim 1, wherein the deodorant stick composition has a hardness of at least 600-gram force.

14. The deodorant stick product according to claim 1, wherein a ratio of an initial height of the deodorant stick composition to a height of a holding material is from 1:2 to 3:2.

15. The deodorant stick product according to claim 1, wherein a ratio of an initial height of the deodorant stick composition to a breadth of the deodorant stick composition is from 1:2 to 3:2.

16. The deodorant stick product according to claim 1, wherein the deodorant stick product is an antiperspirant stick.

17. The deodorant stick product according to claim 1, wherein the deodorant stick product is suitable for application to human axillary regions.

18. The deodorant stick product according to claim 1, having an obround cross-section when viewed from above.

19. A method of reducing perspiration comprising topically applying the packaged deodorant stick product according to claim 1 to a surface of a human body.

20. The method of reducing perspiration according to claim 19 wherein the surface of the human body is the axillary region.

* * * * *